US005928828A

United States Patent [19]

Suzuki

[11] Patent Number: 5,928,828

[45] Date of Patent: Jul. 27, 1999

[54] ELECTROPHOTOGRAPHIC IMAGE FORMING METHOD

[75] Inventor: Yasuo Suzuki, Shizuoka, Japan

[73] Assignee: Ricoh Company, Ltd., Tokyo, Japan

[21] Appl. No.: 09/018,853

[22] Filed: Feb. 4, 1998

[30] Foreign Application Priority Data

Feb. 5, 1997 [JP] Japan ..... 9-035717
Feb. 4, 1998 [JP] Japan ..... 10-036558

[51] Int. Cl.[6] ..... G03G 13/22

[52] U.S. Cl. ..... 430/126; 430/31; 430/66; 430/67; 430/58; 430/59; 430/902

[58] Field of Search ..... 430/31, 66, 58, 430/59, 126, 902

[56] References Cited

U.S. PATENT DOCUMENTS 5,561,016 10/1996 Suzuki et al. ..... 430/59
5,578,405 11/1996 Ikegami et al. ..... 430/59
5,677,096 10/1997 Suzuki ..... 430/59

*Primary Examiner*—Roland Martin
*Attorney, Agent, or Firm*—Oblon, Spivak, McClelland, Maier & Neustadt, P.C.

[57] ABSTRACT

An electrophotographic image forming method using an electrophotographic photoconductor includes the steps of charging the photoconductor to a predetermined polarity using a charger which may be disposed in contact with the photoconductor, exposing the charged photoconductor to light images to form latent electrostatic images thereon, developing the latent electrostatic images into visible images with a toner, and transferring the visible toner images formed on the photoconductor to an image receiving member using an image transfer charger which may be disposed in contact with the photoconductor, with the photoconductor comprising a surface top layer which contains a compound of formula (I):

(I)

wherein $R^1$ is a lower alkyl group; $R^2$ and $R^3$ are each independently methylene group which may have a substituent or ethylene group which may have a substituent; $Ar^1$ and $Ar^2$ are each an aryl group which may have a substituent; and l is an integer of 0 to 4, and m and n are each an integer of 0 to 2 provided that $m+n \geqq 2$ and $l+m+n \leqq 6$.

7 Claims, 3 Drawing Sheets

ELECTROPHOTOGRAPHIC IMAGE FORMING METHOD

BACKGROUND OF THE INVENTION

1. Field of the Invention

The present invention relates to an image forming method using an electrophotographic photoconductor, and more particularly to an electrophotographic image forming method comprising the steps of charging the electrophotographic photoconductor to a predetermined polarity by use of a charging member, which may be in contact with the photoconductor, and transferring a developed toner image formed on the photoconductor to an image receiving member using an image transfer charging member, which may be in contact with the photoconductor.

2. Discussion of Background

Various inorganic materials such as Se, CdS and ZnO are conventionally employed as photoconductive materials for an electrophotographic photoconductor However, because of poor photosensitivity, low thermal stability and toxicity of the above-mentioned inorganic materials, electrophotographic photoconductors employing organic photoconductive materials have been actively developed in recent years, and in fact, a variety of organic photoconductors are applied to the commercially available copying machine and printer.

In an image forming method by means of the above-mentioned electrophotographic photoconductor employing the organic photoconductive material, corona discharge which is caused by applying a high voltage to metallic wire is conventionally used in the charging step and the image transfer step.

When the corona discharge is employed, however, ozone and $NO_x$ are generated in the course of the charging and image transfer steps, which will impair the photoconductor comprising the organic materials.

To solve the above-mentioned problem, the inventors of the present invention have proposed an electrophotographic photoconductor with improved resistance to gases such as ozone and $NO_x$ by specifying an oxygen transmission coefficient of a surface top layer of the photoconductor, as disclosed in Japanese Laid-Open Patent Application 8-272126.

However, it is preferable not to generate ozone and $NO_x$ gases from the viewpoints of safety and hygiene. In recent years, therefore, research and development of contact charging or contact image transfer charging by use of a charger in the form of a roller or belt which is disposed in contact with the photoconductor has been conducted instead of the corona charging, and such a contact charging or image transfer charging method is put in practical use.

Although the generation of gases such as ozone and $No_x$ can be efficiently prevented by the contact charging or contact image transfer charging method, pinholes are readily formed in the surface of the photoconductor because the charging or the image transfer charging is carried out with the charger in the form of a roller or belt in contact with the surface of the photoconductor. Further, cracks are often generated on the surface of the photoconductor by the influence of a material bleeding out of the molded charging roller or belt. Thus, there occurs the problem of image defect due to the pinholes and cracks formed on the photoconductor, which has never occurred in the electrophotographic image forming method employing the conventional corona discharge.

SUMMARY OF THE INVENTION

It is therefore an object of the present invention to provide an electrophotographic image forming method free from the above-mentioned conventional problems, which can constantly produce high quality images for an extended period of time without toner deposition on the background and black stripes in the white background due to the cracks on the photoconductor even though the charging or image transfer charging operation is carried out with the charger being in contact with the photoconductor The above-mentioned object of the present invention can be achieved by an electrophotographic image forming method using an electrophotographic photoconductor, comprising the steps of charging the electrophotographic photoconductor to a predetermined polarity using a charger which is disposed in contact with the photoconductor, exposing the charged photoconductor to light images to form latent electrostatic images thereon, developing the latent electrostatic images formed on the photoconductor into visible images with a toner, and transferring the visible toner images formed on the photoconductor to an image receiving member using an image transfer charger, with the electrophotographic photoconductor comprising a surface top layer which comprises a compound of formula (I):

(I)

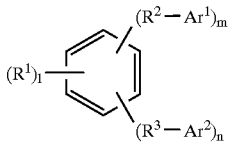

wherein $R^1$ is a lower alkyl group; $R^2$ and $R^3$ are each independently methylene group which may have a substituent or ethylene group which may have a substituent; $Ar^1$ and $Ar^2$ are each an aryl group which may have a substituent; and l is an integer of 0 to 4, and m and n are each an integer of 0 to 2 provided that $m+n \geqq 2$ and $l+m+n \geqq 6$.

In the above-mentioned electrophotographic image forming method, the image transfer charger may be disposed in contact with the surface of the photoconductor.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
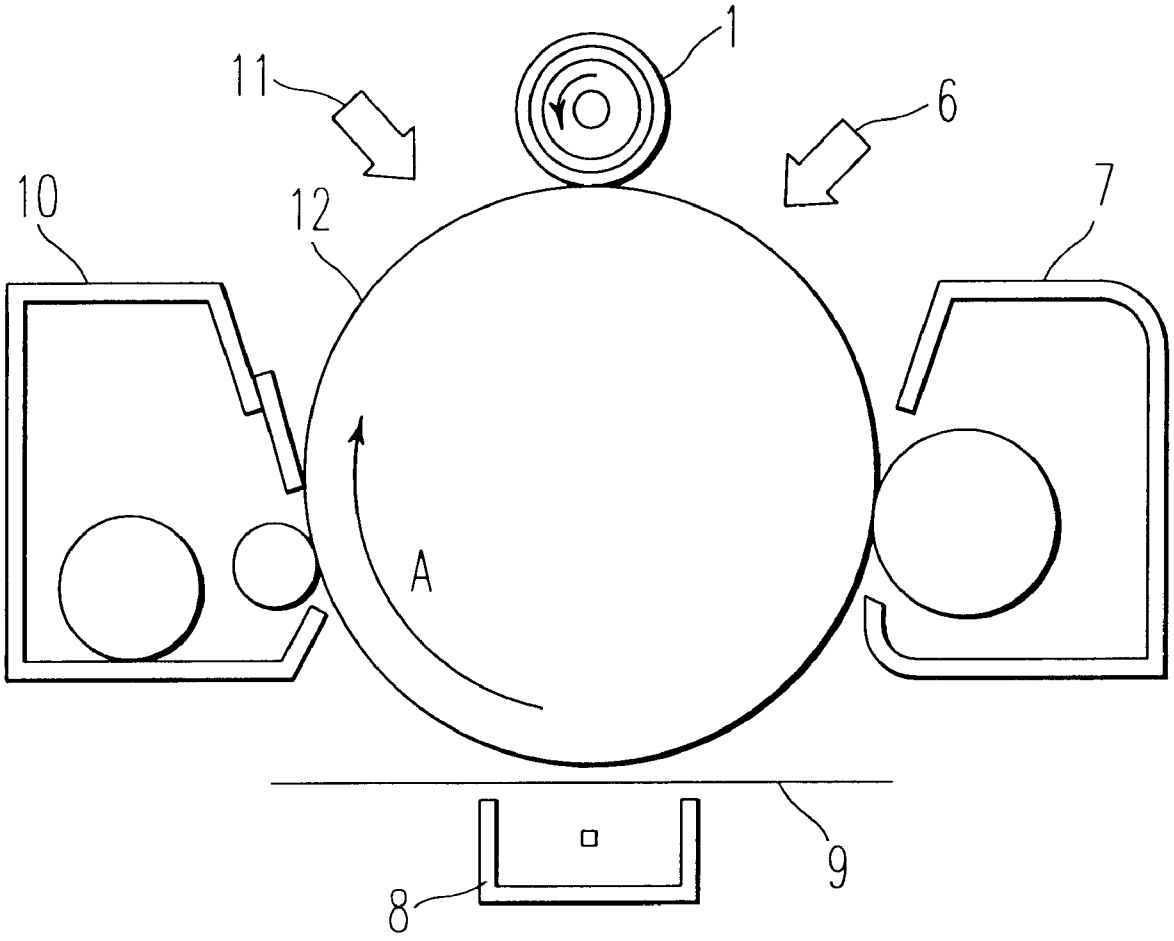
FIG. 1 is a schematic front view which shows one example of an electrophotographic image forming apparatus employing the image forming method of the present invention.

According to the image forming method of the present invention, the electrophotographic photoconductor comprises a surface top layer which comprises a compound of formula (I):

(I)

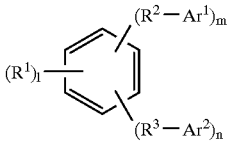

wherein $R^1$ is a lower alkyl group; $R^2$ and $R^3$ are each independently methylene group which may have a substituent or ethylene group which may have a substituent; $Ar^1$ and $Ar^2$ are each an aryl group which may have a substituent; and l is an integer of 0 to 4, and m and n are each an integer of 0 to 2 provided that $m+n \geqq 2$ and $l+m+n \geqq 6$.

In formula (I), the above-mentioned lower alkyl group represented by $R^1$ may preferably have 1 to 6 carbon atoms, and there are employed methyl group and ethyl group.

$R^2$ and $R^3$ may be the same or different. Examples of the substituent of methylene group or ethylene group represented by $R^2$ and $R^3$ include an alkyl group such as methyl group or ethyl group; an aralkyl group such as benzyl group; and an aryl group such as phenyl group.

$Ar^1$ and $Ar^2$ may be the same or different. Examples of the aryl group represented by $Ar^1$ and $Ar^2$ are phenyl group, biphenyl group and naphthyl group.

Examples of the substituent of the aryl group represented by $Ar^1$ and $Ar^2$ include an alkyl group such as methyl group, ethyl group or propyl group; and an aralkyl group such as benzyl group.

In particular, a compound of the following formula (II) is preferably employed as the compound of formula (I).

(II)

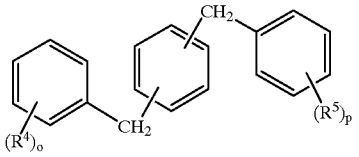

wherein $R^4$ and $R^5$ are each independently a lower alkyl group; and o and p are each an integer of 0 to 3.

Specific examples of the above-mentioned compound of formula (I) are shown in Table 1.

TABLE 1

(I)-1

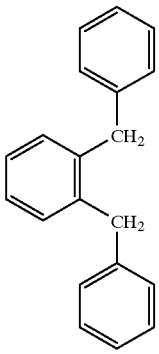

(I)-2

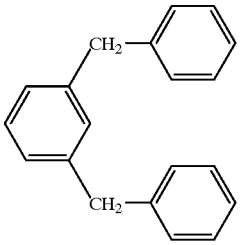

(I)-3

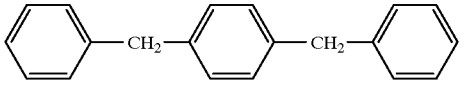

(I)-4

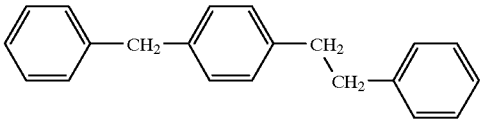

TABLE 1-continued
(I)-5
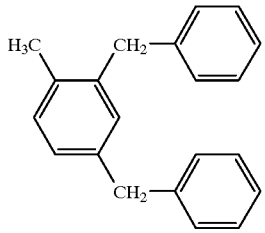
(I)-6
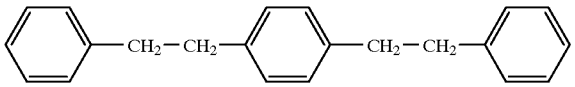
(I)-7
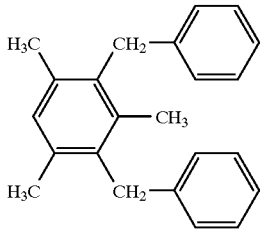
(I)-8
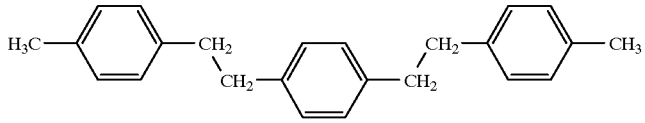
(I)-9
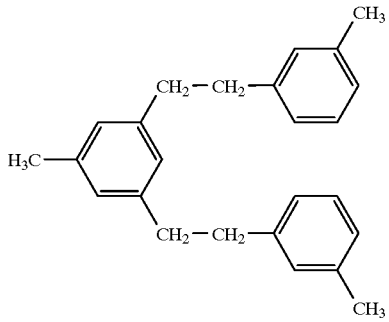
(I)-10
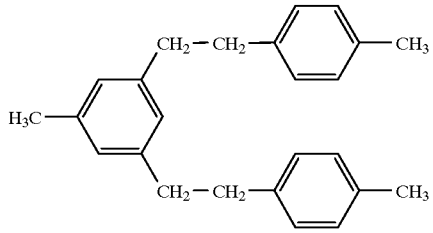
(I)-11
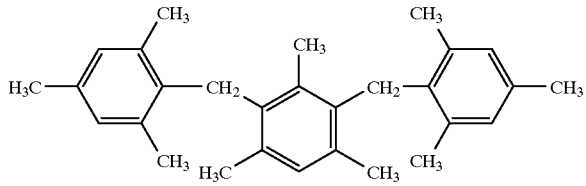

TABLE 1-continued
(I)-12
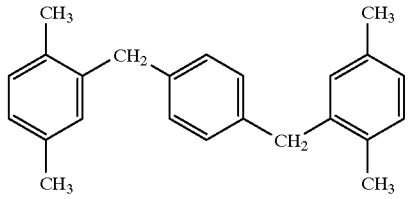
(I)-13
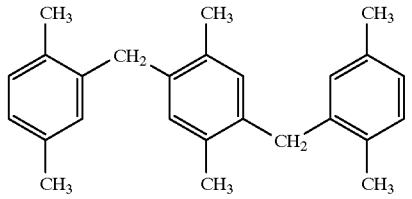
(I)-14
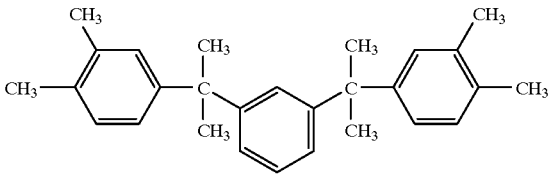
(I)-15
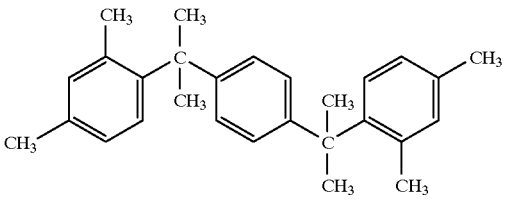
(I)-16
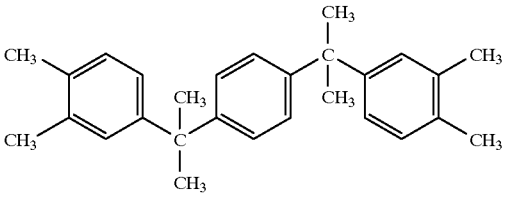
(I)-17
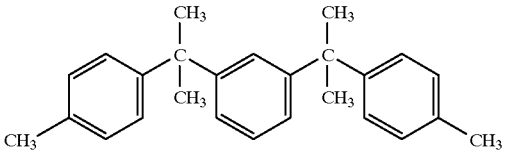
(I)-18
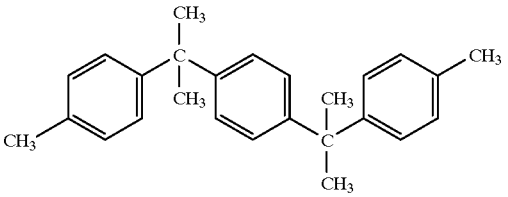

TABLE 1-continued
(I)-19
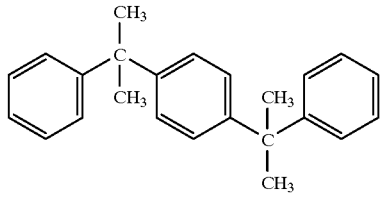
(I)-20
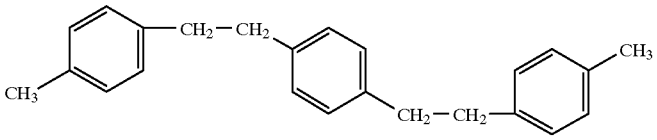
(I)-21
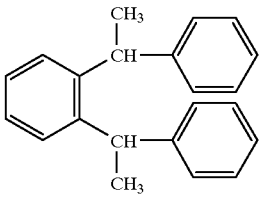
(I)-22
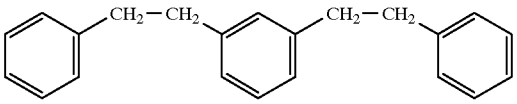
(I)-23
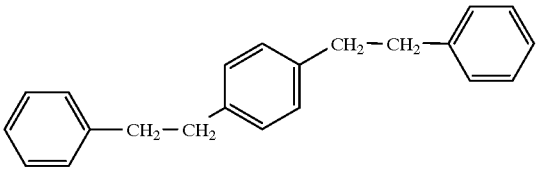
(I)-24
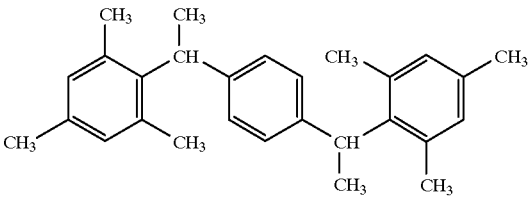
(I)-25
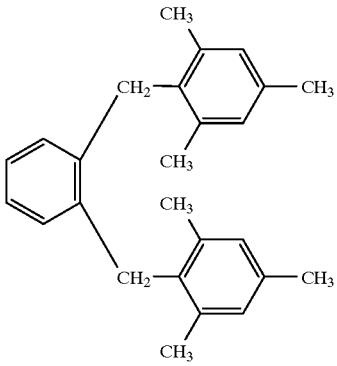

TABLE 1-continued
(I)-26
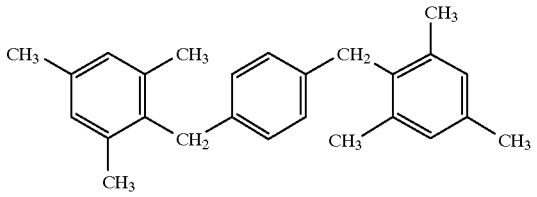
(I)-27
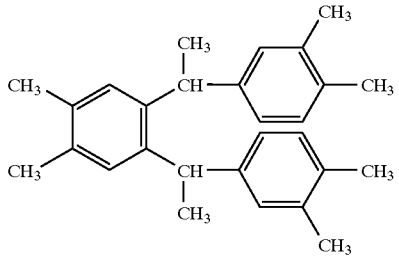
(I)-28
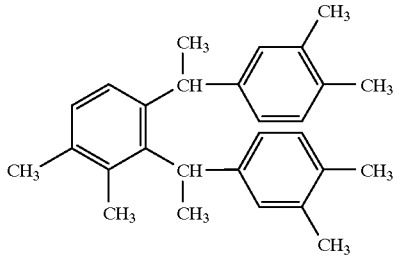
(I)-29
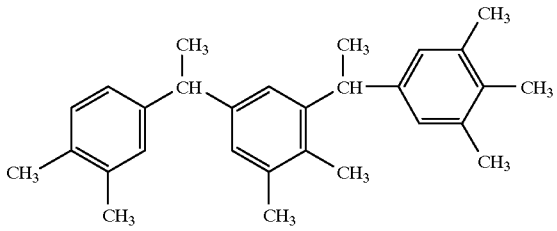
(I)-30
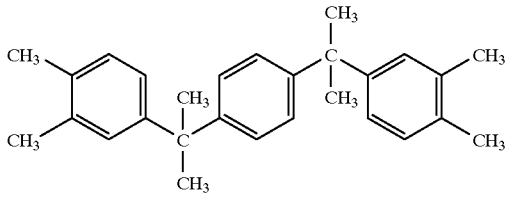
(I)-31
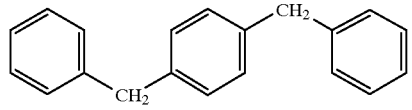
(I)-32
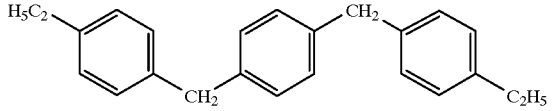

TABLE 1-continued
(I)-33
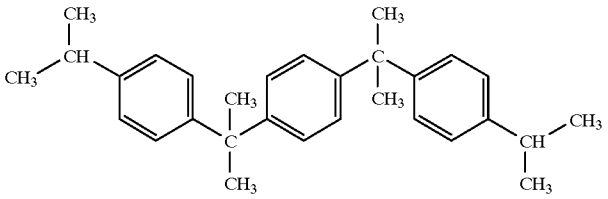
(I)-34
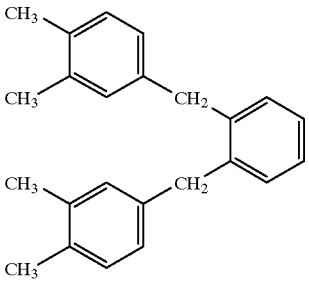
(I)-35
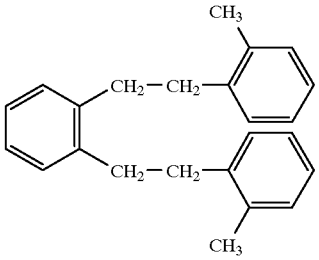
(I)-36
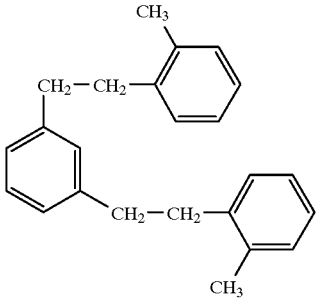
(I)-37
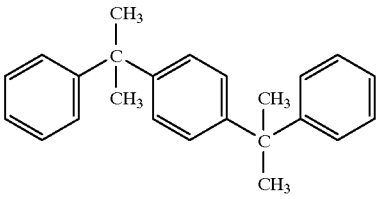
(I)-38
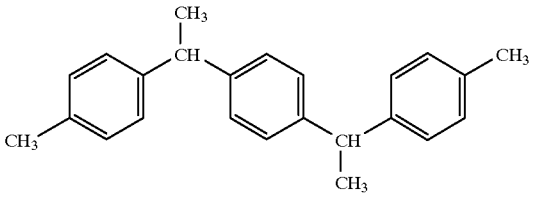

TABLE 1-continued
(I)-39
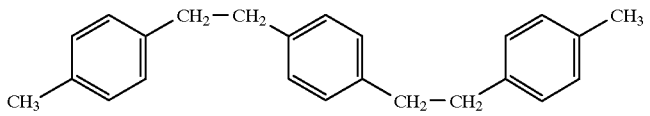
(I)-40
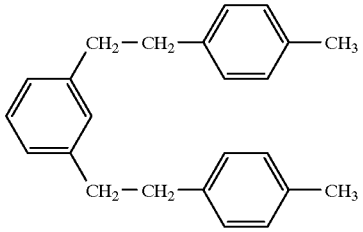
(I)-41
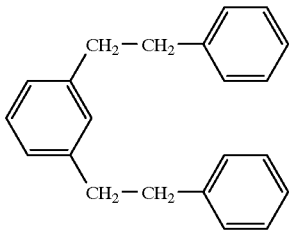
(I)-42
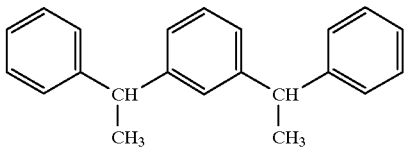
(I)-43
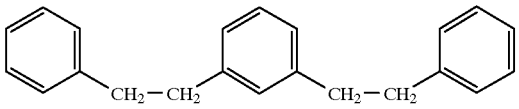
(I)-44
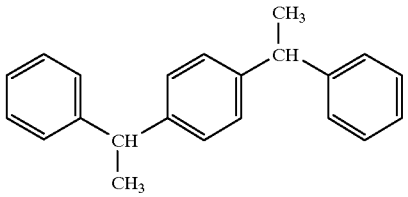
(I)-45
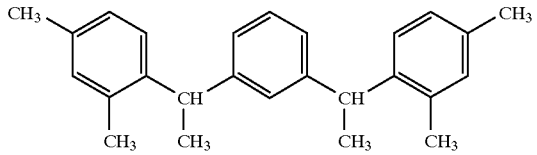
(I)-46
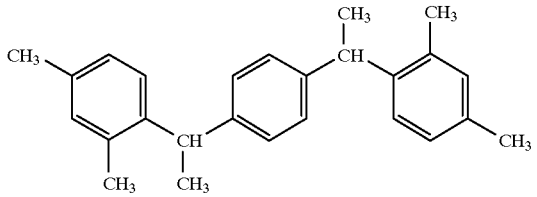

TABLE 1-continued
(I)-47
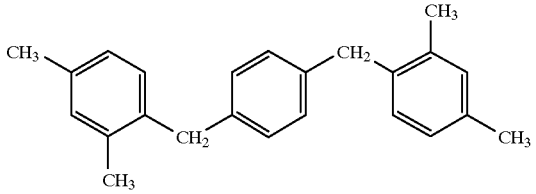
(I)-48
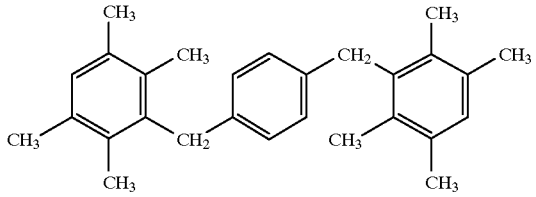
(I)-49
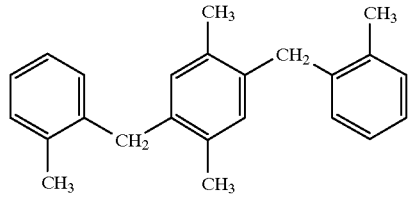
(I)-50
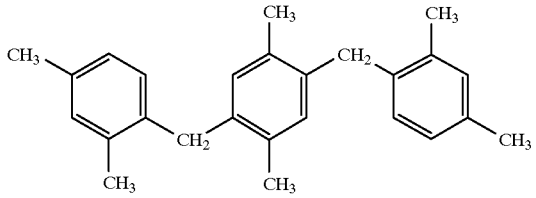
(I)-51
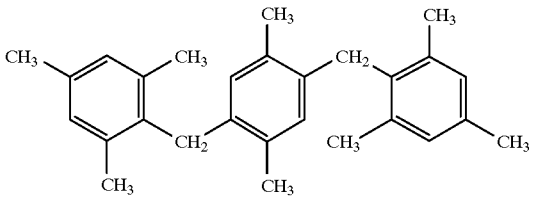
(I)-52
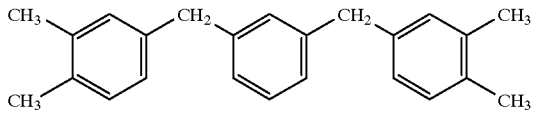
(I)-53
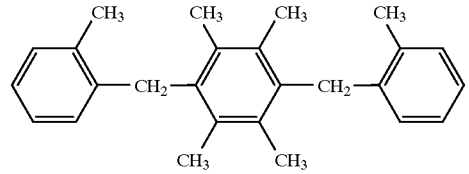
(I)-54
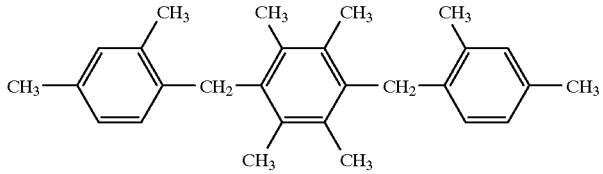

TABLE 1-continued
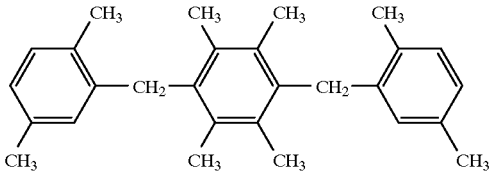
(I)-55
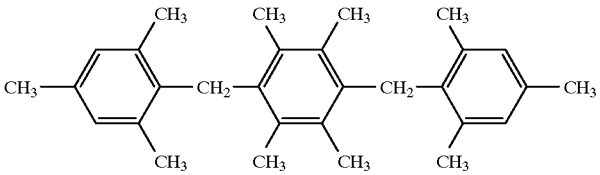
(I)-56
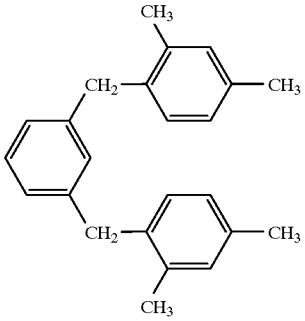
(I)-57
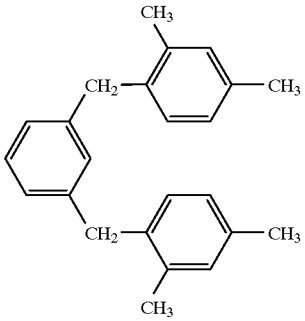
(I)-57
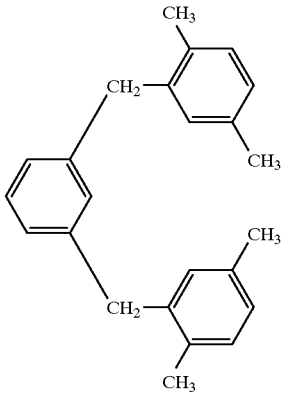
(I)-58

TABLE 1-continued
(I)-59
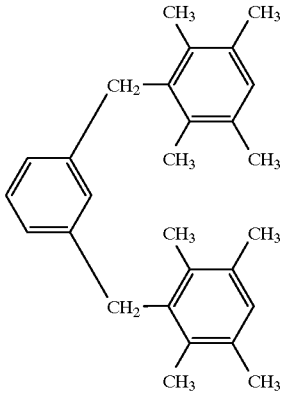
(I)-60
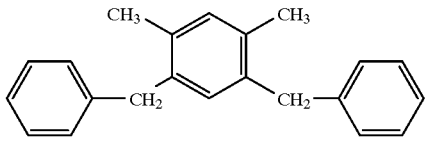
(I)-61
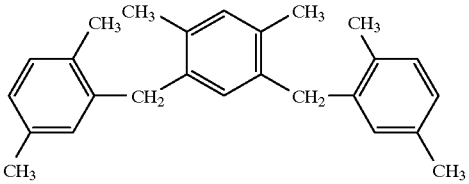
(I)-62
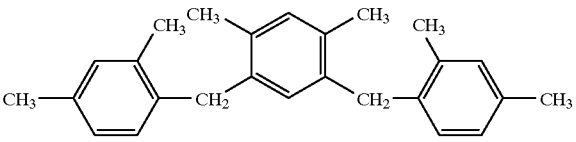
(I)-63
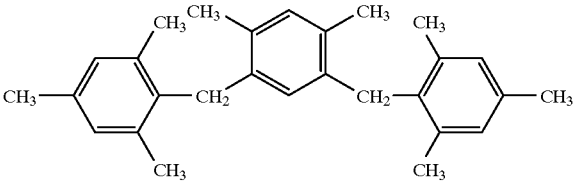
(I)-64
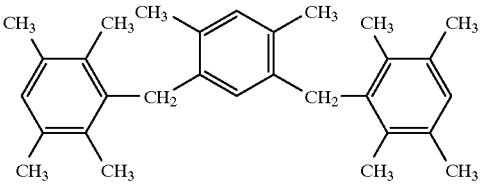
(I)-66
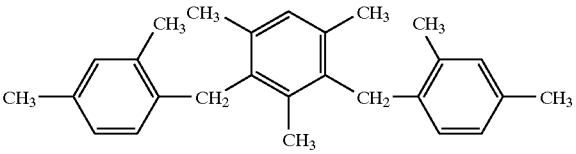

TABLE 1-continued
(I)-67
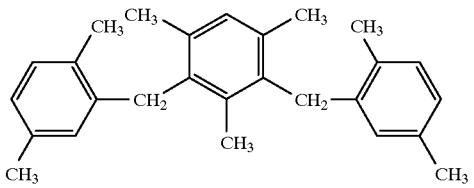
(I)-68
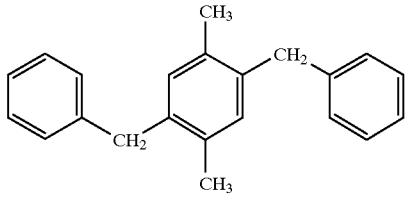
(I)-69
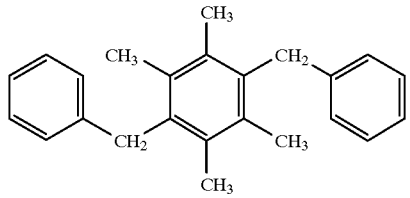
(I)-70
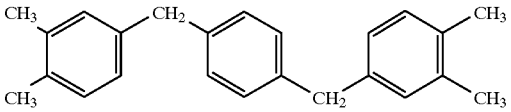
(I)-71
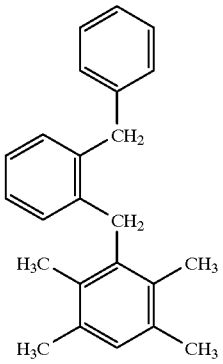
(I)-72
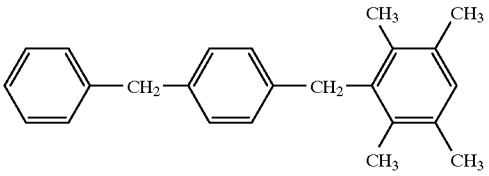
(I)-73
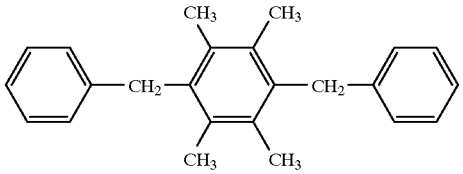

TABLE 1-continued
(I)-74
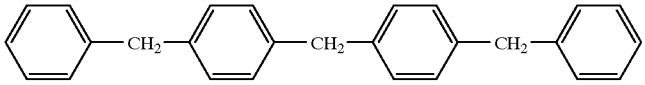
(I)-75
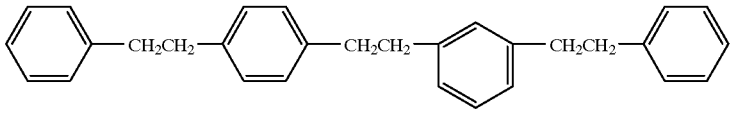
(I)-76
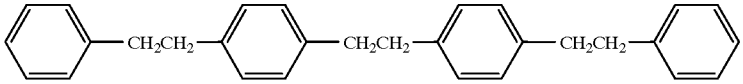
(I)-77
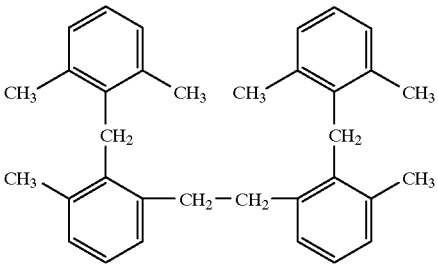
(I)-78
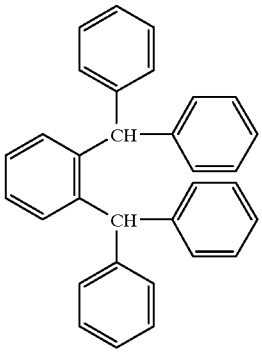
(I)-79
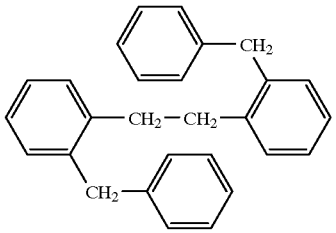
(I)-80
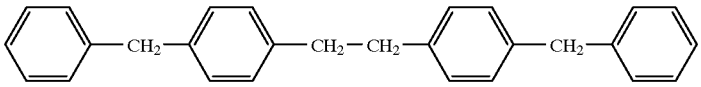

TABLE 1-continued
(I)-81
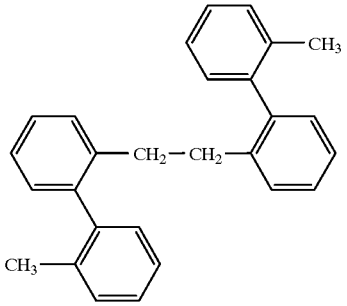
(I)-82
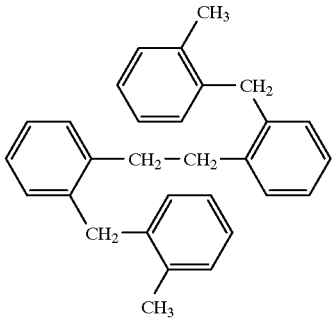
(I)-83
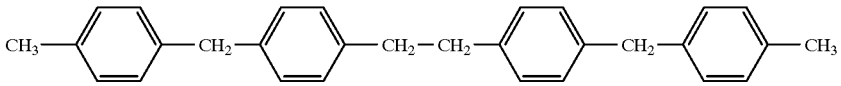
(I)-84
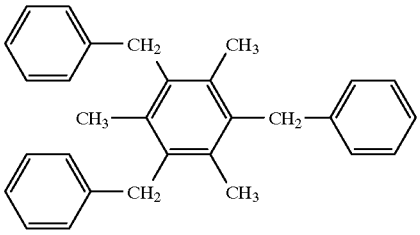
(I)-85
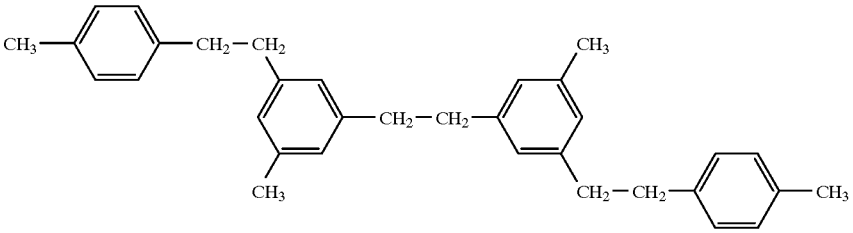

TABLE 1-continued (I)-86

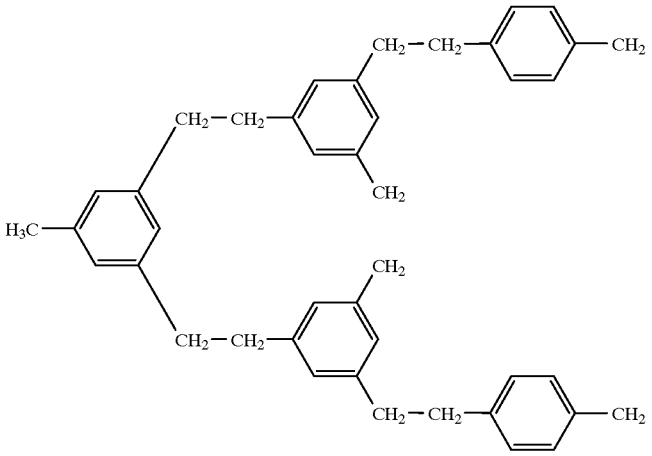

(I)-87

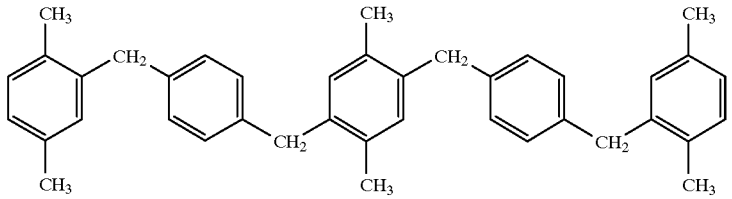

(I)-88

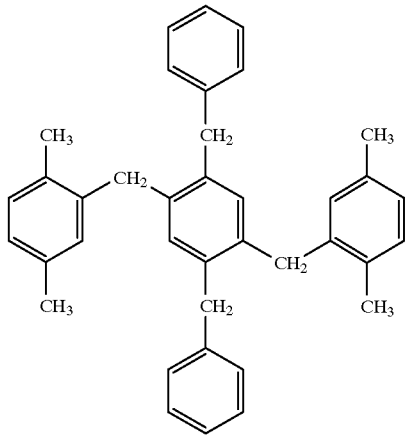

The compound of formula (I) for use in the present invention can be produced, for example, in such a manner that a corresponding chloroalkyl derivative and hydrocarbon are dissolved in nitromethane, and with the addition of a catalyst such as $ZnCl_2$ or $AlCl_3$ to the above prepared solution, the reaction is initiated with stirring in a stream of nitrogen with the reaction temperature being maintained constant.

Even though the photoconductor is charged to a predetermined polarity in contact with the charger and/or the developed toner images formed on the photoconductor are transferred to an image receiving sheet using the image transfer charger which is in contact with the photoconductor, occurrence of image defect can be prevented for an extended period of time when the aforementioned compound of formula (I) is contained in the surface top layer of the employed photoconductor.

The reason why such a compound of formula (I) has a considerable effect on the image formation has not been clarified. However, it is considered that minute void portions in the surface top layer of the photoconductor can be decreased by adding the compound of formula (I) to the formulation for the surface top layer. Therefore, the surface of the photoconductor can be prevented from being contaminated by volatile gases generated from the molded charging member or image transfer charging member which is disposed in contact with the photoconductor, or substances bleeding out of the molded charging member. The above-mentioned charging member or image transfer charging member disposed in contact with the photoconductor will be hereinafter referred to as a contact charger or a contact image transfer charger. In addition, it is considered that the surface top layer of the photoconductor is provided with a plasticizing effect by the addition thereto of the compound of formula (I), so that it is possible to reduce the residual stress which may be generated in the surface top layer when the coating liquid for formation of the surface top layer is dried, thereby preventing the occurrence of cracks.

The electrophotographic photoconductor for use in the present invention comprises an electroconductive support and a photoconductive layer formed thereon. When the photoconductive layer is of a single-layered type, the photoconductive layer may comprise the compound of formula (I). When the photoconductive layer comprises a charge generation layer and a charge transport layer which are successively overlaid on the electroconductive support, it is preferable that the charge transport layer be provided on the charge generation layer as the surface top layer and comprise the compound of formula (I).

Furthermore, when the photoconductor further comprises a protective layer which is overlaid on the photoconductive layer, the protective layer may comprise the compound of formula (I).

It is preferable that the amount of compound of formula (I) be in the range of 1 to 50 parts by weight, more preferably in the range of 3 to 30 parts by weight, to 100 parts by weight of a binder resin for use in the surface top layer of the photoconductor. When the amount of compound of formula (I) is within the above-mentioned range, image defect can be effectively prevented without decreasing the sensitivity of the photoconductor and increasing the residual potential thereof.

The electrophotographic image forming method of the present invention will be explained in detail with reference to FIGS. 1 through 3.

As shown in FIG. 1, around an electrophotographic photoconductor 12 which is rotated in a direction of arrow A, there are situated a charger 1, which is in contact with the surface of the photoconductor 12, and an image transfer charger 8. In this case, the image transfer charger 8, which is a corona charger, is out of contact with the surface of the photoconductor 12. The photoconductor 12 is positively or negatively charged to a predetermined voltage by the charger 1 in the charging step and the image transfer charger 8 in the image transfer step. It is desirable that a direct voltage in the range of −2,000 V to +2,000 V be applied to the charger 1 in the charging step. Alternatively, a pulsating voltage obtained by superimposing an alternating voltage on the above-mentioned direct voltage may be applied to the charger 1 and the image transfer charger 8. In such a case, the alternating voltage with a peak-to-peak voltage of 4,000 V or less may be employed. However, when the alternating voltage is superimposed on the direct voltage, the charger, the image transfer charger and the photoconductor may cause vibrations, thereby making abnormal noise.

A desired voltage may be applied to the charger 1 or the image transfer charger 8 instantaneously by one operation. Alternatively, the applied voltage may be gradually increased to a predetermined voltage in order to protect the photoconductor 12.

Figure 2:
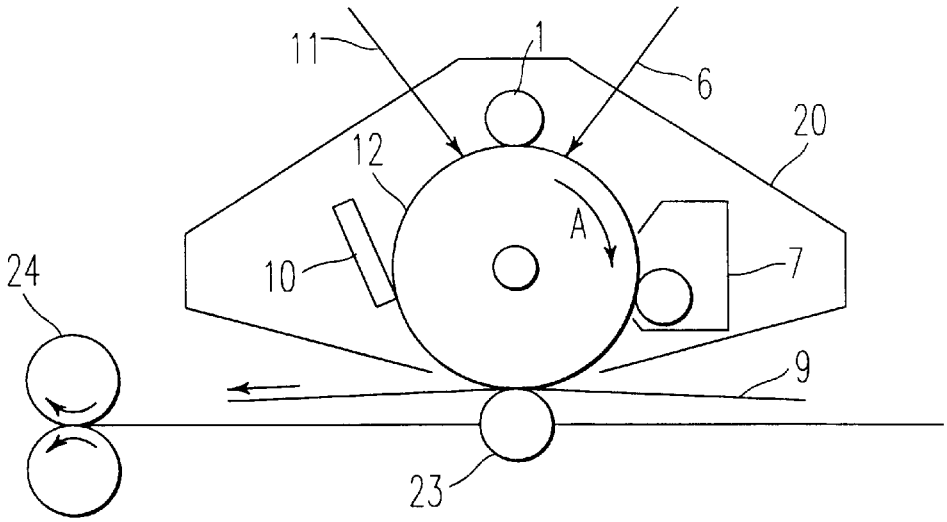
FIG. 2 is a schematic front view which shows another example of an electrophotographic image forming apparatus employing the image forming method of the present invention.
Figure 3:
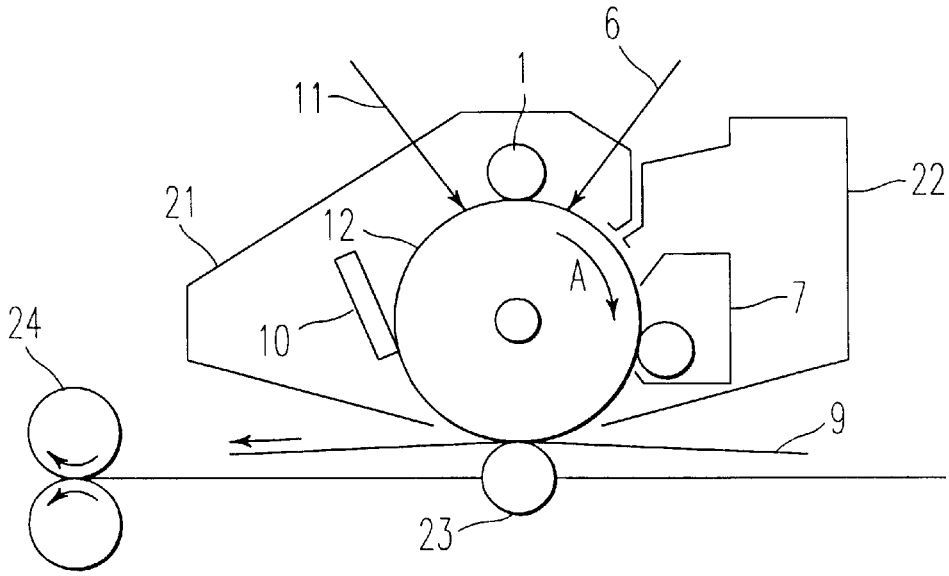
FIG. 3 is a schematic front view which shows a further example of an electrophotographic image forming apparatus employing the image forming method of the present invention.

AS shown in FIGS. 2 and 3, there is employed a charging roller 23 as the image transfer charger, with which the surface of the photoconductor is charged, as mentioned above, when coming in direct contact with the image transfer charging roller 23. The charger 1 and the image transfer charging roller 23 may be rotated in the same direction as that of the photoconductor 12, or not, and alternatively, may come in sliding contact with the outer surface of the photoconductor 12 without rotating. In addition, the charger 1 and the image transfer charger 8 or 23 may be provided with the function of removing residual toner deposited on the surface of the photoconductor 12. In this case, a cleaning means 10 becomes unnecessary.

The photoconductor 12 which has been charged to a predetermined polarity using the charger 1 is then exposed to light images 6 by means of slit exposure or laser beam scanning exposure. Thus, there are formed on the surface of the photoconductor 12 latent electrostatic images corresponding to the light images.

The thus formed latent electrostatic images are developed into visible images with a toner using a development unit 7.

The visible toner images formed on the photoconductor 12 are transferred to an image receiving member 9 using the image transfer charger 8 or 23. In this case, the image receiving member 9 is transported to a position between the photoconductor 12 and the image transfer charger 8 or 23 by a paper feeding unit (not shown), and the transportation of the image receiving member 9 is synchronized with the rotation of the photoconductor 12.

The image receiving member 9 which bears the toner image thereon is separated from the surface of the photoconductor 12 and guided to an image fixing unit 24 where the toner image deposited on the image receiving member 9 is fixed thereto. Thus, the image-bearing image receiving member 9 is discharged from the image forming apparatus.

After the image transfer step, the residual toner is removed from the surface of the photoconductor 12 by use of the cleaning means 10, and then, the surface of the photoconductor 12 is subjected to quenching treatment by being exposed to light using quenching means 11.

Such an electrophotographic image forming process can be repeatedly carried out.

A plurality of units constituting the electrophotographic image forming apparatus, such as the photoconductor 12 and the development unit 7, may be incorporated into one body that can be detached from the image forming apparatus. For instance, as shown in FIG. 2, at least the photoconductor 12, the charger 1, the image transfer charger 23 and the development unit 7 may be incorporated into an electrophotographic unit 20, which is detachable from the image forming apparatus. In attaching the electrophotographic unit 20 to the apparatus or detaching the same therefrom, the electrophotographic unit 20 may be caused to pass through a guide rail formed in the image forming apparatus. In this case, the cleaning unit 10 may not be included in the electrophotographic unit 20. Alternatively, as shown in FIG. 3, there may be separately prepared a first electrophotographic unit 21 comprising at least the photoconductor 12, the charger 1 and the image transfer charger 23, and a second electrophotographic unit 22 comprising at least the development unit 7. Those units 21 and 22 may be designed to be independently detachable from the image forming apparatus. The cleaning unit 10 may not be included in the first electrophotographic unit 21.

In FIGS. 2 and 3, it is preferable that a direct voltage of 400 to 2,000 V be applied to the image transfer charger 23.

The electrophotographic photoconductor for use in the present invention will now be explained in detail with reference to FIGS. 4 to 7.

Figure 4:
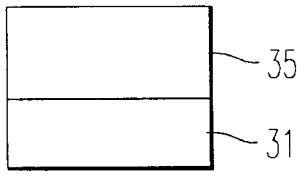
FIGS. 4 to 7 are schematic cross sectional views, each of which shows the structure of an electrophotographic photoconductor for use in the present invention.

FIG. 4 is a cross-sectional view which shows one example of the electrophotographic photoconductor for use in the present invention. The photoconductor shown in FIG. 4 comprises an electroconductive support 31 and a photoconductive layer 35 formed thereon.

Figure 5:
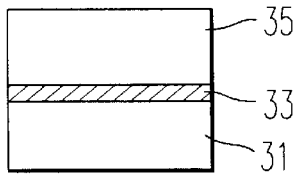

In an electrophotographic photoconductor shown in FIG. 5 an undercoat layer 33 is interposed between the electroconductive support 31 and the photoconductive layer 35.

Figure 6:
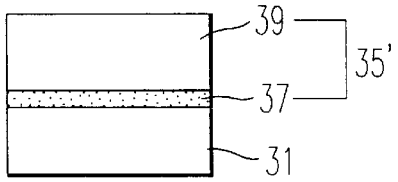

In FIG. 6, an photoconductive layer 35' for use in an electrophotographic photoconductor comprises a charge generation layer 37 and a charge transport layer 39.

Figure 7:
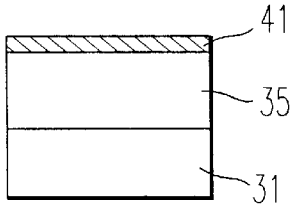

An electrophotographic photoconductor shown in FIG. 7 further comprises a protective layer 41 which is provided on the photoconductive layer 35.

To prepare the electroconductive support 31, an electroconductive material with a volume resistivity of $10^{10}$ Ω·cm or less, for example, a metal such as aluminum, nickel, chromium, nichrome, copper, gold, silver or platinum; or a metallic oxide such as tin oxide or indium oxide is coated by deposition or sputtering on a supporting material, e.g., a plastic film or a sheet of paper, which may be fabricated in a cylindrical form. Alternatively, a plate of aluminum, aluminum alloy, nickel or stainless steel can be used as the electroconductive support 31; and the above-mentioned metal plate may be made into a tube by extrusion or pultrusion and subjected to surface treatment such as cutting, superfinishing and grinding. In addition, an endless nickel belt and an endless stainless steel belt as disclosed in Japanese Laid-Open Patent Application 52-36016 can be used as the electroconductive support 31.

In addition to the above, the electroconductive support 31 can be obtained in such a manner that electroconductive finely-divided particles are dispersed in an appropriate binder resin and the thus prepared coating liquid for an electroconductive layer is coated on the above-mentioned supporting materials.

Specific examples of the above-mentioned electroconductive finely-divided particles for use in the electroconductive layer are carbon black; acetylene black; powder of metals such as aluminum, nickel, iron, nichrome, copper, zinc and silver; and powder of metallic oxides such as electroconductive titanium oxide, electroconductive tin oxide and indium tin oxide (ITO).

Specific examples of the binder resin used with the above-mentioned electroconductive finely-divided particles are thermoplastic, thermosetting and photosetting resins such as polystyrene, styrene - acrylonitrile copolymer, styrene - butadiene copolymer, styrene - maleic anhydride copolymer, polyester, polyvinyl chloride, vinyl chloride - vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyltoluene, poly-N-vinylcarbazole, acrylic resin, silicone resin, epoxy resin, melamine resin, urethane resin, phenolic resin, and alkyd resin. A mixture of the aforementioned electroconductive finely-divided particles and binder resin may be dispersed in a proper solvent such as tetrahydrofuran, dichloromethane, 2-butanone or toluene, and the thus prepared coating liquid for the electroconductive layer may be coated on the supporting material, thereby obtaining the electroconductive support 31.

In addition, a heat-shrinkable tubing obtained by adding the above-mentioned electroconductive particles to a material such as polyvinyl chloride, polypropylene, polyester, polystyrene, polyvinylidene chloride, polyethylene, chlorinated rubber or Teflon may be provided on an appropriate cylindrical supporting material to prepare the electroconductive support 31.

When the photoconductive layer 35' comprises the charge generation layer 37 and the charge transport layer 39 as shown in FIG. 6, the charge generation layer 37 may consist of a charge generation material, or may comprise a binder resin and the charge generation material dispersed therein.

To prepare the charge generation layer 37, the above-mentioned components are dispersed in a proper solvent in a ball mill, an attritor or a sand mill, or using the ultrasonic wave to prepare a coating liquid for the charge generation layer 37. The coating liquid for the charge generation layer 37 is applied to the electroconductive support 31 or the undercoat layer 33, and then dried.

Examples of the charge generation material for use in the charge generation layer 37 are azo pigments such as bisazo pigment, trisazo pigment and tetraazo pigment; phthalocyanine pigments; quinocyanine pigments; indigo pigments; bisbenzimidazole pigments; quinacridone pigments; and azulene compounds.

Specific examples of the binder resin for use in the charge generation layer 37 are polyamide, polyurethane, epoxy resin, polyketone, polycarbonate, silicone resin, acrylic resin, polyvinyl butyral, polyvinyl formal, polyvinyl ketone, polystyrene, polyvinylcarbazole, polyacrylamide, polyvinyl benzal, polyester, phenoxy resin, vinyl chloride - vinyl acetate copolymer, polyvinyl acetate, polyamide, polyvinylpyridine, cellulose resin, casein, polyvinyl alcohol and polyvinylpyrrolidone.

It is preferable that the amount of the binder resin for use in the charge generation layer 37 be in the range of 10 to 500 parts by weight, more preferably in the range of 25 to 300 parts by weight, to 100 parts by weight of the charge generation material.

The thickness of the charge generation layer 37 is preferably in the range of 0.01 to 5 $\mu$m, more preferably in the range of 0.1 to 2 $\mu$m.

Examples of the solvent used for the formation of the charge generation layer 37 are isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene and ligroine.

The coating liquid for the charge generation layer 37 is applied to the electroconductive support 31 by dip coating, spray coating, beads coating, nozzle coating, spinner coating or ring coating.

To form the charge transport layer 39 as shown in FIG. 6, the previously mentioned compound of formula (I), a charge transport material, and a binder resin are dissolved or dispersed in an appropriate solvent for obtaining a coating liquid for the charge transport layer 39. The thus obtained coating liquid may be coated on the charge generation layer 37 and dried, so that the charge transport layer 39 is provided on the charge generation layer 37.

The charge transport material for use in the charge transport layer 39 includes a positive hole transport material and an electron transport material.

Examples of the electron transport material are electron acceptor materials such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno{1,2-b}thiophene-4-on, 1,3,7-trinitrodibenzo-thiophene-5,5-dioxide and benzoquinone derivatives.

Examples of the positive hole transport material for use in the present invention are poly-N-vinylcarbazole and derivatives thereof, poly-$\gamma$-carbazolyl ethyl glutamate and derivatives thereof, pyrene - formaldehyde condensate and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, $\alpha$-phenyl stilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis-stilbene derivatives, enamine derivatives, and other conventional positive hole transport materials.

The above-mentioned charge transport materials may be used alone or in combination.

Examples of the binder resin for use in the charge transport layer 39 are thermoplastic and thermosetting resins such as polystyrene, styrene - acrylonitrile copolymer, styrene - butadiene copolymer, styrene - maleic anhydride copolymer, polyester, polyvinyl chloride, vinyl chloride - vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyltoluene, poly-N-vinylcarbazole, acrylic resin, silicone resin, epoxy resin, melamine resin, urethane resin, phenolic resin, alkyd resin, and various kinds of polycarbonate copolymers as disclosed in Japanese Laid-Open Patent Application Nos. 5-158250 and 6-51544.

It is preferable that the amount of the charge transport material in the charge transport layer 39 be in the range of 20 to 300 parts by weight, more preferably in the range of 40 to 150 parts by weight, to 100 parts by weight of the binder resin.

It is preferable that the thickness of the charge transport layer 39 be in the range of 5 to 50 μm.

Examples of the solvent used for preparing the charge transport layer are tetrahydrofuran, dioxane, toluene, monochlorobenzene, dichloroethane, dichloromethane, cyclohexanone, methyl ethyl ketone and acetone The charge transport layer 39 may further comprise a plasticizer, a leveling agent and an antioxidant when necessary.

Any plasticizers used for general resins, such as dibutyl phthalate and dioctyl phthalate, may be contained in the charge transport layer 39. It is preferable that the amount of the plasticizer be in the range of about 0 to 30 parts by weight to 100 parts by weight of the binder resin for use in the charge transport layer 39.

Examples of the leveling agent for use in the charge transport layer 39 are silicone oils such as dimethyl silicone oil and methylphenyl silicone oil; and polymers and oligomers having a perfluoroalkyl group on the side chain thereof. It is preferable that the amount of the leveling agent be in the range of 0 to 1 part by weight to 100 parts by weight of the binder resin for use in the charge transport layer 39.

Examples of the antioxidant for use in the present invention are hindered phenol compounds, sulfur-containing compounds, phosphorus-containing compounds, hindered amine compounds, pyridine derivatives, piperidine derivatives, morpholine derivatives, and hydroquinone compounds.

It is proper that the amount of the antioxidant be in the range of 0 to 5 parts by weight to 100 parts by weight of the binder resin for use in the charge transport layer 39.

When the photoconductive layer for use in the electrophotographic photoconductor is of a single-layered type as shown in FIG. 4, the same charge generation material and charge transport material as mentioned above may be employed in the single-layered photoconductive layer 35. To be more specific, the above-mentioned charge generation material, charge transport material, a binder resin and the compound of formula (I) are dissolved or dispersed in a proper solvent to prepare a coating liquid for the photoconductive layer 35, and the thus prepared coating liquid may be coated on the electroconductive support 31, and dried. When necessary, the coating liquid for the photoconductive layer 35 may further comprise the above-mentioned plasticizer, leveling agent, and antioxidant.

As the binder resin used for the formation of the above-mentioned single-layered photoconductive layer 35, the same binder resins as mentioned in the formation of the charge transport layer 39 may be used alone, or such binder resins may be used in combination with the binder resins as employed in the formation of the charge generation layer 37.

Further, there can be employed a single-layered photoconductive layer 35 comprising a eutectic complex of pyrylium dye and bisphenol polycarbonate and a positive hole transport material added thereto.

The single-layered photoconductive layer 35 is provided on the electroconductive support 31 or the undercoat layer 33, as shown in FIG. 4 or FIG. 5, by dispersing the charge generation material, the charge transport material, the binder resin and the compound of formula (I) in a solvent such as tetrahydrofuran, dioxane, dichloroethane, cyclohexanone, or dichloromethane using a dispersion mixer to prepare a coating liquid for the photoconductive layer 35, and coating the thus prepared coating liquid on the electroconductive support 31 or the undercoat layer 33 by dip coating, spray coating or beads coating.

It is preferable that the thickness of the single-layered photoconductive layer 35 be in the range of about 5 to 50 μm.

As previously mentioned, the undercoat layer 33 may be interposed between the electroconductive support 31 and the photoconductive layer 35, as shown in FIG. 5.

The undercoat layer 33 comprises a resin as the main component, with finely-divided particles of metallic oxide pigments being optionally added thereto.

It is desirable that the resin for use in the undercoat layer 33 have high resistance to generally used organic solvents because the photoconductive layer 35 is provided on the undercoat layer 33 using an organic solvent. Preferable examples of the resin for use in the undercoat layer 33 are water-soluble resins such as polyvinyl alcohol, casein and sodium polyacrylate; alcohol-soluble resins such as copolymerized nylon and methoxymethylated nylon; ethylenic resins such as ethylene - vinyl acetate copolymer, ethylene - vinyl acetate - maleic anhydride copolymer, and ethylene - vinyl acetate - methacrylic acid copolymer; vinyl chloride resins such as vinyl chloride - vinyl acetate copolymer and vinyl chloride - vinyl acetate - maleic anhydride copolymer; and cured resins with a three-dimensional network structure such as cellulose derivative resin, polyurethane, melamine resin, phenolic resin, alkyd - melamine resin, acryl - melamine resin, silicone resin, silicone - alkyd resin, epoxy resin, and polyisocyanate compound.

The undercoat layer 33 may comprise finely-divided particles of metallic oxide pigments such as titanium oxide, aluminum oxide, silica, zirconium oxide, tin oxide and indium oxide to prevent the occurrence of Moiré fringe and reduce the residual potential.

The undercoat layer 33 may further comprise a silane coupling agent, a titanium coupling agent, a chromium coupling agent, a titanyl chelate compound, a zirconium chelate compound, a titanyl alcoxide compound, or an organic titanyl compound.

The undercoat layer 33 can be formed on the electroconductive support 31 by the same conventional coating method using the same solvent as mentioned in the formation of the charge generation layer 37 and the charge transport layer 39.

In addition to the above, a thin film of $Al_2O_3$ may be formed as the undercoat layer 33 on the electroconductive support 31 by anodizing process, or a thin film of an organic material such as poly-p-xylylene, or an inorganic material such as $SiO_2$, $SnO_2$, $TiO_2$, ITO or $CeO_2$ may be vacuum-deposited on the electroconductive support 31 to form a thin film of the undercoat layer 33.

The proper thickness of the undercoat layer 33 is in the range of 0 to 10 μm.

The protective layer 41 may be further provided on the photoconductive layer 35, as shown in FIG. 7, to protect the surface of the photoconductor.

Examples of a resin for use in the protective layer 41 are acrylonitrile - butadiene - styrene (ABS) resin, ACS resin, copolymer of olefin and a vinyl monomer, chlorinated polyether, allyl resin, phenolic resin, polyacetal, polyamide, polyamideimide, polyacrylate, polyallylsulfone, polybutylene, polybutylene terephthalate, polycarbonate, polyether sulfone, polyethylene, polyethylene terephthalate, polyimide, acrylic resin, polymethylpentene, polypropylene, polyphenyleneoxide, polysulfone, polystyrene, acrylonitrile - styrene (AS) resin, butadiene - styrene copolymer, polyurethane, polyvinyl chloride, polyvinylidene chloride, and epoxy resin.

To improve the wear resistance of the protective layer 41, the protective layer 41 may further comprise a fluorine-containing resin such as polytetrafluoroethylene, and a silicone resin. Further, an inorganic material such as titanium oxide, tin oxide or potassium titanate may be employed in the protective layer 41.

The protective layer 41 is formed on the photoconductive layer 35 by the conventional coating method.

The proper thickness of the protective layer 41 is in the range of 0.1 to 10 $\mu$m.

In addition to the above, the conventional materials such as a-carbon (amorphous carbon) and a-SiC (amorphous silicon carbide) may be vacuum-deposited on the photoconductive layer 35 to form a thin film of the protective layer 41.

Furthermore, in the electrophotographic photoconductor of the present invention, an intermediate layer (not shown) may be provided between the photoconductive layer 35 and the protective layer 41.

The above-mentioned intermediate layer comprises as the main component a resin, such as polyamide, alcohol-soluble nylon resin, water-soluble butyral resin, polyvinyl butyral, or polyvinyl alcohol.

The intermediate layer may be provided by the conventional coating method in a thickness of 0.05 to 2 $\mu$m.

The charger 1, and the image transfer charger 8 or 23, as shown in FIGS. 1 to 3, for use in the electrophotographic image forming method of the present invention may be in the form of a roller, brush, blade, belt or a plate.

When the charger 1 and the image transfer charger 8 or 23 are in the form of a roller, the roller comprises an electroconductive core, and an elastic layer, an electroconductive layer and a high-resistant layer which are successively provided on the electroconductive core.

For the material of the electroconductive core for use in the charging roller, metals such as iron, copper and stainless steel, and electroconductive resins such as a carbon-dispersed resin and a metallic-powder-dispersed resin can be employed. The electroconductive core may be in the form of a rod or a plate.

The elastic layer provided on the electroconductive core is a layer with high elasticity and low rigidity The thickness of the elastic layer is 1.5 mm or more, preferably 2 mm or more, and more preferably in the range of 3 to 13 mm.

Examples of the material for use in the elastic layer include chloroprene rubber, isoprene rubber, EPDM rubber, polyurethane rubber, epoxy rubber, and butyl rubber.

The electroconductive layer provided on the elastic layer is a layer with high electrical conductivity. It is preferable that the volume resistivity of the electroconductive layer be in the range of $10^7$ Ω·cm or less, more preferably in the range of $10^6$ Ω·cm or less, and further preferably in the range of $10^{-2}$ Ω·cm to $10^6$ Ω·cm.

It is desirable to decrease the thickness of the electroconductive layer so that the flexibility of the elastic layer provided under the electroconductive layer may not be lost. The thickness of the electroconductive layer is 3 mm or less, preferably 2 mm or less, and more preferably in the range of 20 $\mu$m to 1 mm.

For the electroconductive layer of the charging roller, a metal-deposited film, an electroconductive-particles-dispersed resin, and an electroconductive resin can be employed.

For the preparation of the electroconductive layer using the metal-deposited film, metals such as aluminum, indium, nickel, copper and iron may be deposited on the elastic layer. The electroconductive-particles-dispersed resin can be prepared by dispersing finely-divided particles of an electroconductive material such as carbon, aluminum, nickel or titanium oxide in a resin such as urethane resin, polyester, vinyl acetate - vinyl chloride copolymer, or polymethyl methacrylate. When the electroconductive resin is employed for the formation of the electroconductive layer, there can be employed quaternary-ammonium-salt-containing-polymethyl methacrylate, polyvinylaniline, polyvinylpyrrole, polydiacetylene, and polyethylene-imine.

The high-resistant layer is provided on the above-mentioned electroconductive layer. It is preferable that the volume resistivity of the high-resistant layer be in the range of $10^6$ to $10^{12}$ Ω·cm, and more preferably in the range of $10^7$ to $10^{11}$ Ω·cm.

For the preparation of the high-resistant layer, there can be employed a semiconductive resin, and an electrical-insulating resin in which electroconductive particles are dispersed.

Examples of the semiconductive resin for use in the high-resistant layer are ethyl cellulose, nitrocellulose, methoxymethylated nylon, ethoxymethylated nylon, copolymerized nylon, polyvinylpyrrolidone, and casein. Those resins may be used in combination.

Alternatively, a small amount of electroconductive particles may be dispersed in an electrical-insulating resin such as urethane, polyester, vinyl acetate - vinyl chloride copolymer, or polymethacrylic acid to control the volume resistivity of the obtained high-resistant layer.

Examples of the above-mentioned electroconductive particles are particles of carbon, aluminum, indium oxide, and titanium oxide.

It is preferable that the thickness of the high-resistant layer be in the range of 1 to 500 $\mu$m, and more preferably in the range of 50 to 200 $\mu$m, from the viewpoint of charging performance.

When the charger or image transfer charger is prepared in the form of a plate, the electroconductive layer and the high-resistant layer may be successively provided on the elastic layer. In such a case, the electroconductive core is unnecessary.

When the charger or image transfer charger in the form of a blade is employed, the elastic layer and the high-resistant layer may be successively provided on a metallic plate.

The charger or image transfer charger in the form of a brush may be prepared by providing electroconductive fibers on the outer surface of the electroconductive core in a radial manner via an adhesive layer, or providing the electroconductive fibers all over a metallic plate via the adhesive layer.

The electroconductive fibers for use in the present invention show high electroconductivity, and it is preferable that the volume resistivity of the electroconductive fibers be in the range of $10^8$ Ω·cm or less, more preferably in the range of $10^6$ Ω·cm or less, and further preferably in the range of $10^{-2}$ to $10^6$ Ω·cm.

Further, in order to maintain the flexibility of the electroconductive fibers, an electroconductive fiber may be fine. For example, the diameter of an electroconductive fiber may be in the range of 1 to 100 μm, preferably in the range of 5 to 50 μm, and more preferably in the range of 8 to 30 μm. It is desirable that the length of the electroconductive fiber be in the range of 2 to 10 mm, and more preferably in the range of 3 to 8 mm.

Examples of the material for the electroconductive fibers include the previously mentioned electroconductive-particles-dispersed resin and electroconductive resin. In addition to the above, carbon fibers can be used as the electroconductive fibers for use in the present invention.

Other features of this invention will become apparent in the course of the following description of exemplary embodiments, which are given for illustration of the invention and are not intended to be limiting thereof.

EXAMPLE 1

<Fabrication of Electrophotographic Photoconductor>

[Formation of undercoat layer]

A mixture of the following components was dispersed in a ball mill for 72 hours to prepare a coating liquid for the undercoat layer:

| | Parts by Weight |
|---|---|
| Titanium oxide (Trademark "CR-EL", made by Ishihara Sangyo Kaisha, Ltd.) | 70 |
| Alkyd resin (Trademark "Beckolite M6401-50-S" with a solid content of 50%, made by Dainippon Ink & Chemicals, Incorporated) | 15 |
| Melamine resin (Trademark "Super Beckamine L-121-60" with a solid content of 60%, made by Dainippon Ink & Chemicals, Incorporated) | 10 |
| Methyl ethyl ketone | 100 |

The thus prepared coating liquid was coated on an aluminum drum with a diameter of 80 mm and a length of 359 mm and dried at 130° C. for 20 minutes. Thus, an undercoat layer with a thickness of 3 μm was provided on the aluminum drum.

[Formation of charge generation layer]

10 parts by weight of a trisazo pigment represented by the following formula (III) were added to a resin solution prepared by dissolving 4 parts by weight of the commercially available polyvinyl butyral resin (Trademark "BM-2", made by Sekisui Chemical Co., Ltd.) in 150 parts by weight of cyclohexanone. The resultant mixture was dispersed in a ball mill for 72 hours.

(III)

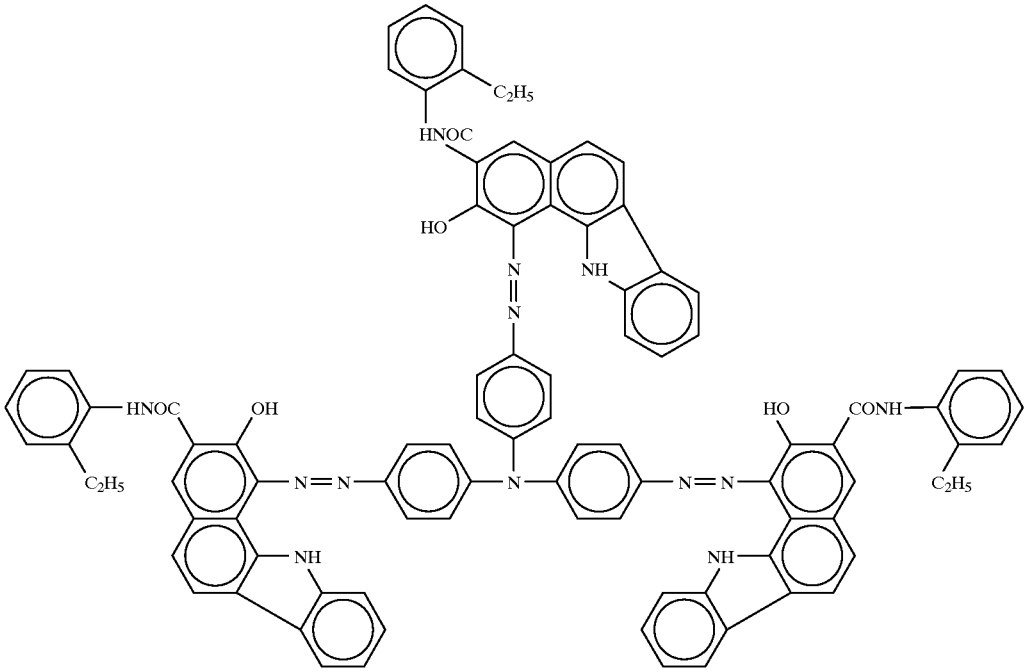

Thereafter, the mixture was further dispersed for 3 hours with the addition thereto of 210 parts by weight of cyclohexanone, whereby a coating liquid for a charge generation layer was obtained. The thus obtained coating liquid was coated on the above prepared undercoat layer, and dried at 130° C. for 10 minutes, so that a charge generation layer with a thickness of 0.2 μm was provided on the undercoat layer.

[Formation of charge transport layer]

The following components were dissolved in 100 parts by weight of dichloromethane, so that a coating liquid for a charge transport layer was prepared;

| | Parts by Weight |
|---|---|
| Charge transport material of formula (IV): | 7 |
| Z type polycarbonate (viscosity-average molecular weight: 50,000) | 10 |
| Silicone oil (Trademark "KF-50" made by Shin-Etsu Chemical Co., Ltd.) | 0.002 |
| Compound (I)-10 in Table 1 | 2 |
| 2,5-di-tertiary-butyl hydroquinone | 0.02 |

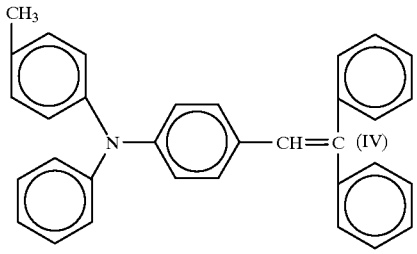

The thus prepared coating liquid was coated on the above prepared charge generation layer, and dried at 130° C. for 15 minutes, so that a charge transport layer with a thickness of 25 μm was provided on the charge generation layer.

Thus, an electrophotographic photoconductor No. 1 for use in the present invention was fabricated.

The thus fabricated electrophotographic photoconductor No. 1 was incorporated into the commercially available digital copying machine (Trademark "IMAGIO MF530", made by Ricoh Company, Ltd.) to carry out image formation and conduct a durability test. In the durability test, the charger or the image transfer charger originally installed in the copying machine was independently replaced by a charging roller which was brought into contact with the photoconductor. The charging roller was designed in such a manner that an urethane rubber layer with a thickness of 7.5 mm and a width of 330 mm was provided on a stainless-steel-made rod with a diameter of 5 mm and a length of 350 mm. In the urethane rubber layer, electroconductive carbon particles were dispersed in an amount of 4.5 parts by weight relative to 100 parts by weight of the urethane rubber. The volume resistivity of such a charging roller was $10^6$ Ω·cm.

The electrophotographic photoconductor No. 1 was charged in such a manner that a direct voltage of −1600 V was applied to the charger, and the developed toner images formed on the photoconductor No. 1 were transferred to a recording sheet with a voltage of positive polarity being applied to the image transfer charger.

Using a chart bearing a solid image thereon with a ratio by area of 5%, 50,000 copies were continuously made under the circumstances of 35° C. and 70% RH in the above-mentioned durability test.

Appearance of black spots with a size of 0.1 mm or more in the white background area of the recording sheet and occurrence of abnormal image due to the crack of the photoconductor were observed during the continuous copying operation.

Table 2 shows the number of recording sheets subjected to continuous copying operation which was carried out until the number of black spots appearing on the recording sheet exceeded one spot/cm$^2$, and the presence or absence of abnormal image resulting from the crack of the photoconductor, with the charger for charging the photoconductor in the charging step being replaced by the above-mentioned charging roller.

Table 3 shows the results of image evaluation carried out in the same manner as in Table 2, with the image transfer charger being replaced by the above-mentioned charging roller.

EXAMPLE 2

The procedure for fabrication of the electrophotographic photoconductor No. 1 in Example 1 was repeated except that the compound (I)-10 for use in the coating liquid for the charge transport layer in Example 1 was replaced by the compound (I)-40 shown in Table 1, so that an electrophotographic photoconductor No. 2 for use in the present invention was fabricated.

The image formation was carried out and the durability test was conducted in the same manner as in Example 1 by incorporating the electrophotographic photoconductor No. 2 into the copying machine. The results of image evaluation are shown in Tables 2 and 3.

EXAMPLE 3

The procedure for fabrication of the electrophotographic photoconductor No. 1 in Example 1 was repeated except that the compound (I)-10 for use in the coating liquid for the charge transport layer in Example 1 was replaced by the compound (I)-61 shown in Table 1, so that an electrophotographic photoconductor No. 3 for use in the present invention was fabricated.

The image formation was carried out and the durability test was conducted in the same manner as in Example 1 by incorporating the electrophotographic photoconductor No. 3 into the copying machine. The results of image evaluation are shown in Tables 2 and 3.

EXAMPLE 4

The procedure for fabrication of the electrophotographic photoconductor No. 1 in Example 1 was repeated except that the compound (I)-10 for use in the coating liquid for the charge transport layer in Example 1 was replaced by the compound (I)-34 shown in Table 1, so that an electrophotographic photoconductor No. 4 for use in the present invention was fabricated.

The image formation was carried out and the durability test was conducted in the same manner as in Example 1 by incorporating the electrophotographic photoconductor No. 4 into the copying machine. The results of image evaluation are shown in Tables 2 and 3.

EXAMPLE 5

The procedure for fabrication of the electrophotographic photoconductor No. 1 in Example 1 was repeated except that the compound (I)-10 for use in the coating liquid for the charge transport layer in Example 1 was replaced by the compound (I)-70 shown in Table 1, so that an electrophotographic photoconductor No. 5 for use in the present invention was fabricated.

The image formation was carried out and the durability test was conducted in the same manner as in Example 1 by incorporating the electrophotographic photoconductor No. 5 into the copying machine. The results of image evaluation are shown in Tables 2 and 3.

EXAMPLE 6

The procedure for fabrication of the electrophotographic photoconductor No. 1 in Example 1 was repeated except that the compound (I)-10 for use in the coating liquid for the charge transport layer in Example 1 was replaced by the compound (I)-12 shown in Table 1, so that an electrophotographic photoconductor No. 6 for use in the present invention was fabricated.

The image formation was carried out and the durability test was conducted in the same manner as in Example 1 by incorporating the electrophotographic photoconductor No. 6 into the copying machine. The results of image evaluation are shown in Tables 2 and 3.

COMPARATIVE EXAMPLE 1

The procedure for fabrication of the electrophotographic photoconductor No. 1 in Example 1 was repeated except that the compound (I)-10 for use in the coating liquid for the charge transport layer in Example 1 was removed from the formulation for the charge transport layer coating liquid, so that a comparative electrophotographic photoconductor No. 1 was fabricated.

The image formation was carried out and the durability test was conducted in the same manner as in Example 1 by incorporating the comparative electrophotographic photoconductor No. 1 into the copying machine. The results of image evaluation are shown in Tables 2 and 3.

COMPARATIVE EXAMPLE 2

The procedure for fabrication of the electrophotographic photoconductor No. 1 in Example 1 was repeated except that the compound (I)-10 for use in the coating liquid for the charge transport layer in Example 1 was replaced by o-terphenyl, so that a comparative electrophotographic photoconductor No. 2 was fabricated.

The image formation was carried out and the durability test was conducted in the same manner as in Example 1 by incorporating the comparative electrophotographic photoconductor No. 2 into the copying machine. The results of image evaluation are shown in Tables 2 and 3.

COMPARATIVE EXAMPLE 3

The procedure for fabrication of the electrophotographic photoconductor No. 1 in Example 1 was repeated except that the compound (I)-10 for use in the coating liquid for the charge transport layer in Example 1 was replaced by m-terphenyl, so that a comparative electrophotographic photoconductor No. 3 was fabricated.

The image formation was carried out and the durability test was conducted in the same manner as in Example 1 by incorporating the comparative electrophotographic photoconductor No. 3 into the copying machine. The results of image evaluation are shown in Tables 2 and 3.

TABLE 2

| | Number of Recording Sheets Subjected to Continuous Copying Operation until Appearance of One or More Black Spots (/cm$^2$) | Occurrence of Abnormal Image |
|---|---|---|
| Ex. 1 | 37,000 sheets | None |
| Ex. 2 | 42,000 sheets | None |
| Ex. 3 | 43,000 sheets | None |
| Ex. 4 | No spots until 50,000 sheets | None |
| Ex. 5 | No spots until 50,000 sheets | None |
| Ex. 6 | No spots until 50,000 sheets | None |
| Comp. Ex. 1 | 21,000 sheets | Occurrence of black stripe |
| Comp. Ex. 2 | 28,000 sheets | Occurrence of black stripe |
| Comp. Ex. 3 | 32,000 sheets | None |

TABLE 3

| | Number of Recording Sheets Subjected to Continuous Copying Operation until Appearance of One or More Black Spots (/cm$^2$) | Occurrence of Abnormal Image |
|---|---|---|
| Ex. 1 | 33,000 sheets | None |
| Ex. 2 | 35,000 sheets | None |
| Ex. 3 | 36,000 sheets | None |
| Ex. 4 | No spots until 50,000 sheets | None |
| Ex. 5 | No spots until 50,000 sheets | None |
| Ex. 6 | No spots until 50,000 sheets | None |
| Comp. Ex. 1 | 16,000 sheets | Occurrence of black stripe |
| Comp. Ex. 2 | 22,000 sheets | Occurrence of black stripe |
| Comp. Ex. 3 | 27,000 sheets | None |

According to the electrophotographic image forming method of the present invention, as previously explained, the surface of the electrophotographic photoconductor can be prevented from being damaged even when the charger or image transfer charger is disposed in contact with the photoconductor, so that the surface of the photoconductor can be stably maintained without any crack. Thus, high quality copied images can be continuously produced without any image defect.

Japanese Patent Application No. 9-035717 filed Feb. 5, 1997 and Japanese Patent Application No. 10-036558 filed Feb. 4, 1998 are hereby incorporated by reference.

What is claimed is:

1. An electrophotographic image forming method using an electrophotographic photoconductor, comprising the steps of:

charging said electrophotographic photoconductor to a predetermined polarity using a charger which is disposed in contact with said photoconductor, exposing said charged photoconductor to light images to form latent electrostatic images thereon, developing said latent electrostatic images formed on said photoconductor into visible images with a toner, and transferring said visible toner images formed on said photoconductor to an image receiving member using an image transfer charger, with said electrophotographic photoconductor comprising a surface top layer which comprises a compound of formula (I):

(I)

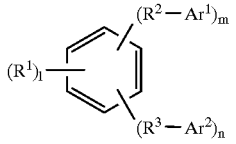

wherein $R^1$ is a lower alkyl group; $R^2$ and $R^3$ are each independently methylene group which may have a substituent or ethylene group which may have a substituent; $Ar^1$ and $Ar^2$ are each an aryl group which may have a substituent; and l is an integer of 0 to 4, and m and n are each an integer of 0 to 2 provided that $m+n \geqq 2$ and $l+m+n \leqq 6$.

2. An electrophotographic image forming method using an electrophotographic photoconductor, comprising the steps of:

charging said electrophotographic photoconductor to a predetermined polarity using a charger, exposing said charged photoconductor to light images to form latent electrostatic images thereon, developing said latent electrostatic images formed on said photoconductor into visible images with a toner, and transferring said visible toner images formed on said photoconductor to an image receiving member using an image transfer charger which is disposed in contact with said photoconductor, with said electrophotographic photoconductor comprising a surface top layer which comprises a compound of formula (I):

(I)

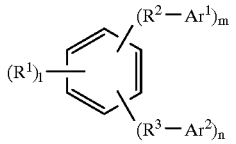

wherein $R^1$ is a lower alkyl group; $R^2$ and $R^3$ are each independently methylene group which may have a substituent or ethylene group which may have a substituent; $Ar^1$ and $Ar^2$ are each an aryl group which may have a substituent; and l is an integer of 0 to 4, and m and n are each an integer of 0 to 2 provided that $m+n \geqq 2$ and $l+m+n \leqq 6$.

3. The electrophotographic image forming method as claimed in claim 1, wherein said image transfer charger is disposed in contact with said photoconductor.

4. The electrophotographic image forming method as claimed in claim 1, wherein said electrophotographic photoconductor comprises an electroconductive support and a photoconductive layer which is provided thereon as said surface top layer of said photoconductor.

5. The electrophotographic image forming method as claimed in claim 4, wherein said photoconductive layer comprises a charge generation layer, and a charge transport layer which is provided on said charge generation layer as said surface top layer of said photoconductor.

6. The electrophotographic image forming method as claimed in claim 4, wherein said electrophotographic photoconductor further comprises a protective layer which is provided on said photoconductive layer as said surface top layer of said photoconductor.

7. The electrophotographic image forming method as claimed in claim 1, wherein said compound of formula (I) comprises a compound of formula (II):

(II)

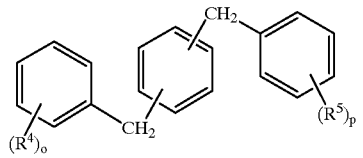

wherein $R^4$ and $R^5$ are each independently a lower alkyl group; and o and p are each an integer of 0 to 3.

* * * * *

UNITED STATES PATENT AND TRADEMARK OFFICE

CERTIFICATE OF CORRECTION

PATENT NO. : 5,928,828
DATED : July 27, 1999
INVENTOR(S) : Yasuo Suzuki

It is certified that error appears in the above-identified patent and that said Letters Patent is hereby corrected as shown below:

Column 31,
Line 50, "AS shown in" should read -- As shown in --.

Column 3,
Line 17, "1+m+n≥6." should read -- *e*+m=n≤6. --.

Column 19,
Table 1, diagram (I)-57,

"

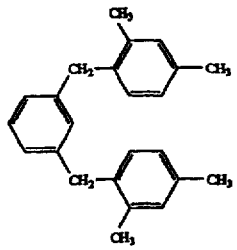

(I)-57 "

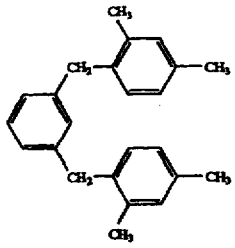

(I)-57

(I)-57 --.

should read --

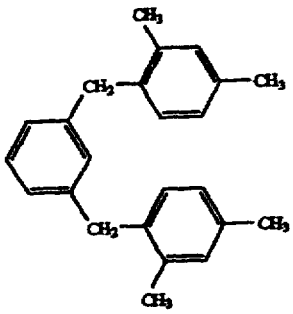

(I)-57 --.

UNITED STATES PATENT AND TRADEMARK OFFICE

CERTIFICATE OF CORRECTION

PATENT NO. : 5,928,828
DATED : July 27, 1999
INVENTOR(S) : Yasuo Suzuki

It is certified that error appears in the above-identified patent and that said Letters Patent is hereby corrected as shown below:

Column 21,
Table 1, should read, -- insert diagram (I)-65 between (I)-64 and (I)-66 --.

(I)-64

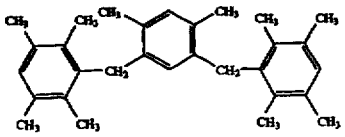

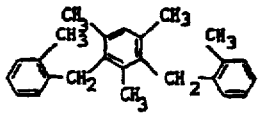

(I) -65

(I)-66

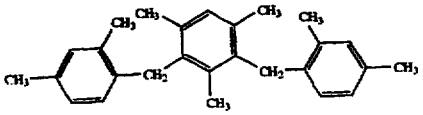

Signed and Sealed this

Eighth Day of January, 2002

*Attest:*

*Attesting Officer*

JAMES E. ROGAN
*Director of the United States Patent and Trademark Office*